US012232643B2

(12) United States Patent
Wan

(10) Patent No.: US 12,232,643 B2
(45) Date of Patent: Feb. 25, 2025

(54) HYDRONIC HEATING PAD

(71) Applicant: Wuxi JHT Homewares Co., Ltd., Wuxi (CN)

(72) Inventor: Yong Wan, Wuxi (CN)

(73) Assignee: Wuxi JHT Homewares CO., LTD., WuXi (CN)

( * ) Notice: Subject to any disclaimer, the term of this patent is extended or adjusted under 35 U.S.C. 154(b) by 697 days.

(21) Appl. No.: 17/467,262

(22) Filed: Sep. 5, 2021

(65) Prior Publication Data

US 2022/0312991 A1 Oct. 6, 2022

(30) Foreign Application Priority Data

Mar. 31, 2021 (CN) ..... 202120656809.5

(51) Int. Cl.

| | |
|---|---|
| ***A47G 9/02*** | (2006.01) |
| ***A47G 9/00*** | (2006.01) |
| ***F24D 13/04*** | (2006.01) |
| ***F24D 19/10*** | (2006.01) |

(52) U.S. Cl.

CPC ..... *A47G 9/0215* (2013.01); *F24D 13/04* (2013.01); *F24D 19/1006* (2013.01); *A47G 2009/008* (2013.01)

(58) Field of Classification Search

CPC ..... G16B 20/00; G16B 20/20; G16B 20/40; G16B 30/00; A47G 2009/008; A47G 9/0215; F24D 13/04; F24D 19/1006; F24H 15/248; F24H 9/2021; H05B 1/0272

See application file for complete search history.

(56) References Cited

U.S. PATENT DOCUMENTS

2022/0304486 A1* 9/2022 Youngblood ..... A47C 21/048

FOREIGN PATENT DOCUMENTS

| | | | |
|---|---|---|---|
| JP | H05312411 A | * | 11/1993 |
| KR | 20030069750 A | * | 8/2000 |
| TW | M604586 U | * | 12/2020 |

* cited by examiner

*Primary Examiner* — Dana Ross
*Assistant Examiner* — Adam M Eckardt
(74) *Attorney, Agent, or Firm* — iPA & iPM

(57) ABSTRACT

A hydronic heating pad includes a control unit and a blanket pad connected to the control unit. The blanket pad includes a warm water region. The control unit includes a water reservoir tank, a heating pipe, an outlet pipe, and at least one return pipe. The heating pipe, the outlet pipe, and at least one return pipe are disposed on the water reservoir tank. The outlet pipe and the at least one return pipe extend into the warm water region, whereby the outlet pipe, the at least one return pipe, and the warm water region form a circulating water channel. The outlet pipe is provided with a water pump. The at least one return pipe is provided with a temperature-sensitive solenoid valve. The blanket pad includes at least two layers of waterproof fabrics. The warm water region is a hermetic region and includes a plurality of first polygon patterns.

12 Claims, 3 Drawing Sheets

HYDRONIC HEATING PAD

CROSS-REFERENCE TO RELATED APPLICATIONS

Pursuant to 35 U.S.C. § 119 and the Paris Convention Treaty, this application claims foreign priority to Chinese Patent Application No. 202120656809.5 filed Mar. 31, 2021, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to the field of bedding, and more particularly, to a hydronic heating pad.

Conventional hydronic heating pads are of an integrated structure, and the pads are heated as a whole. The temperature of different regions of the pad is unadjustable.

In addition, the patterns of conventional hydronic heating pads are composed of single units selected from triangles, squares, and hexagons. These single units have fixed dimensions and are laid on the entire surface of the hydronic heating pad, leading to large flow resistance, large water consumption, thus adversely affecting the water circulation and reducing the heating effect.

SUMMARY

The disclosure provides a hydronic heating pad comprising a control unit and a blanket pad connected to the control unit, and the blanket pad comprises a warm water region.

The control unit comprises a water reservoir tank, a heating pipe, an outlet pipe, and at least one return pipe; the heating pipe, the outlet pipe, and at least one return pipe are disposed on the water reservoir tank; the outlet pipe and the at least one return pipe extend into the warm water region, whereby the outlet pipe, the at least one return pipe, and the warm water region form a circulating water channel; the outlet pipe is provided with a water pump; the at least one return pipe is provided with a temperature-sensitive solenoid valve.

The blanket pad comprises at least two layers of waterproof fabrics; the warm water region is a hermetic region on the blanket pad and comprises a plurality of first polygon patterns; a plurality of water passages is formed between the plurality of first polygon patterns; a plurality of partitions is disposed in part of the plurality of water passages to divide the water passages into a plurality of sub-passages.

In a class of this embodiment, the blanket pad further comprises a controller electrically connected to the temperature-sensitive solenoid valve, the water pump, and the heating pipe, and the controller comprises an operation panel.

In a class of this embodiment, the hermetic region of the warm water region is formed on the blanket pad through a high-frequency heat sealing machine.

In a class of this embodiment, the plurality of first polygon patterns is disposed in a matrix form.

In a class of this embodiment, a water level sensor and a first temperature sensor are disposed in the water reservoir tank, and a second temperature sensor is disposed on the at least one return pipe.

In a class of this embodiment, the outlet pipe communicates with a main stream of the circulating water channel, and the at least one return pipe communicates with a branch of the circulating water channel; the at least one return pipe and the branch of the circulating water channel are equal in number.

In a class of this embodiment, the heating pipe operates under fuzzy power control.

In a class of this embodiment, the plurality of first polygon patterns is hexagonal patterns.

In a class of this embodiment, the warm water region further comprises a plurality of second polygon patterns and a plurality of third polygon patterns; the plurality of second polygon patterns is disposed between the plurality of first polygon patterns, and outer walls of the plurality of second polygon patterns are parallel to corresponding outer walls of the plurality of first polygon patterns, respectively; the plurality of third polygon patterns is disposed between the plurality of first polygon patterns and walls of the hermetic region, and outer walls of the plurality of third polygon patterns are parallel to the walls of the hermetic region and corresponding outer walls of the plurality of first polygon patterns.

In a class of this embodiment, the outlet pipe and the at least one return pipe communicate with the warm water region via corresponding connection pipes.

The following advantages are associated with the hydronic heating pad of the disclosure:

The hydronic heating pad comprises a plurality of sub-passages, and the entire warm water region can be divided into different temperature zones by the plurality of sub-passages, thus achieving the efficient regulation of the temperature of different zones of the warm water region, and meeting the needs of different users. Moreover, the surface of the warm water regions is flat, improving the comfort level of the blanket.

Figure 1:
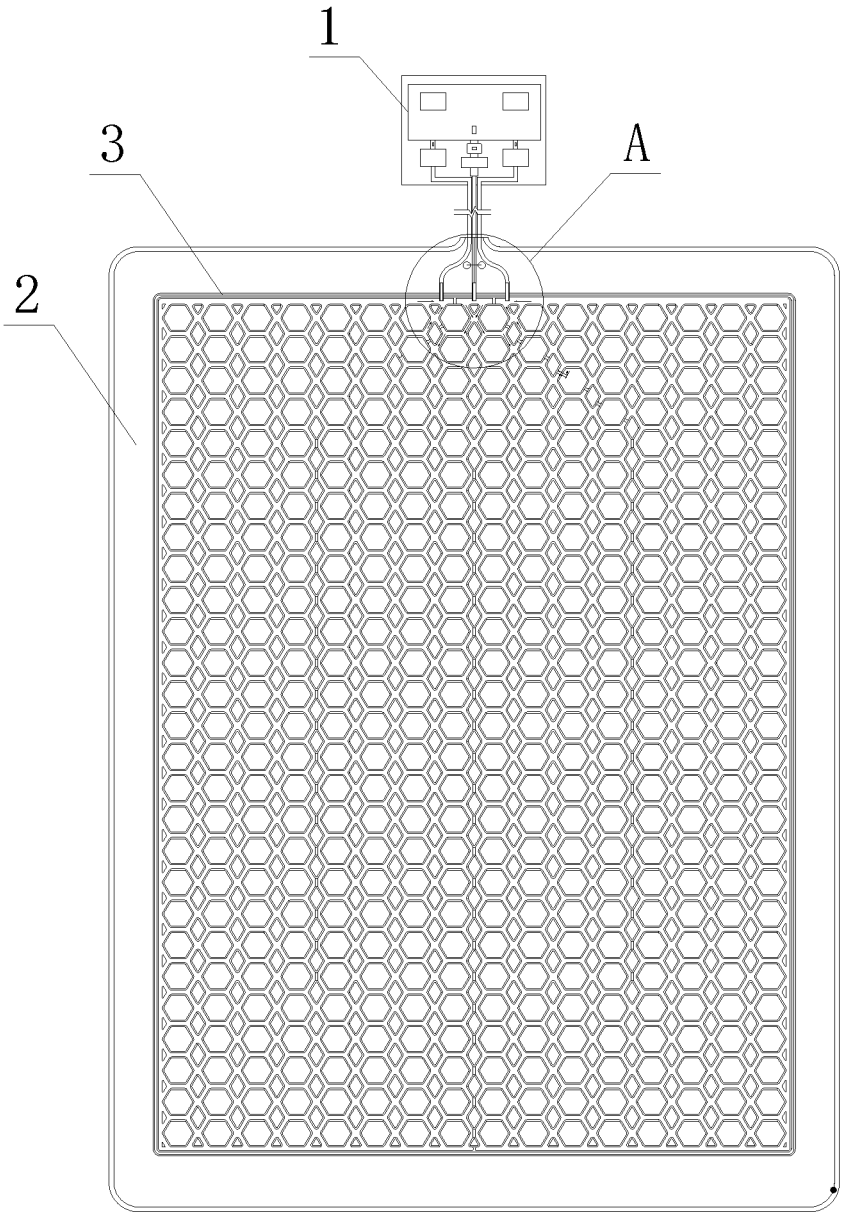
FIG. 1 is a schematic diagram of a hydronic heating pad according to one embodiment of the disclosure.
Figure 2:
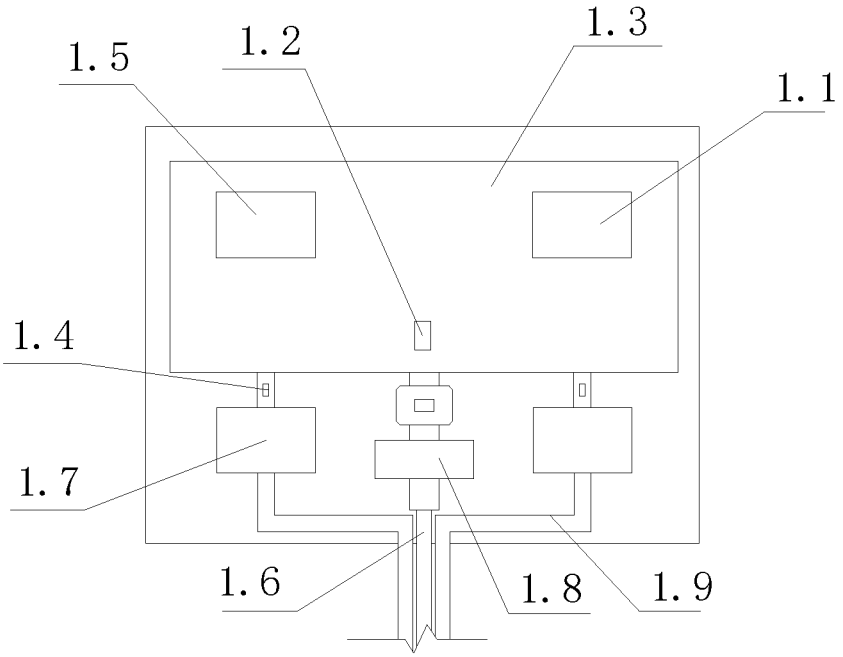
FIG. 2 is an enlarged view of a control unit of a hydronic heating pad according to one embodiment of the disclosure.
Figure 3:
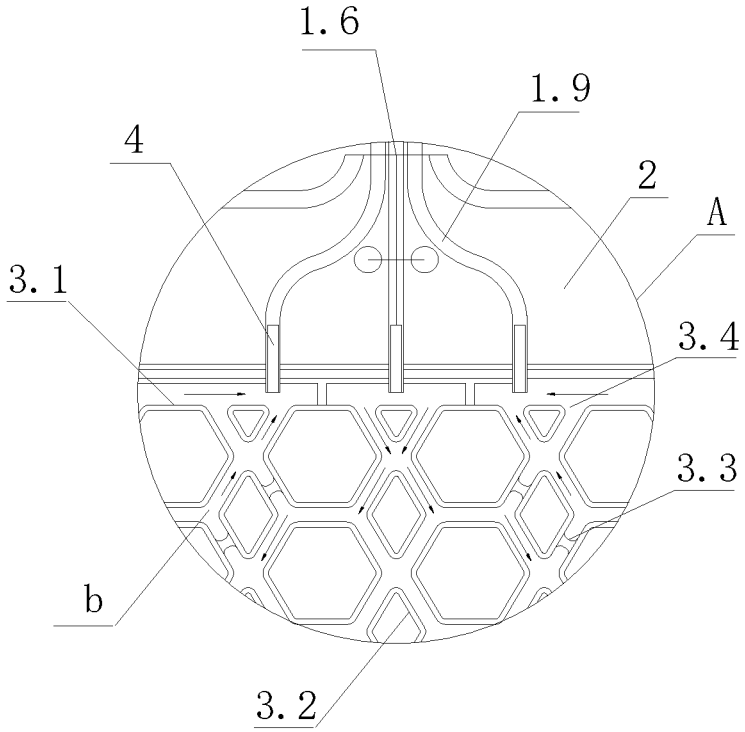
FIG. 3 is an enlarged view of part A in FIG. 1.

In the drawings, the following reference numbers are used: 1. Control unit; 1.1. Water level sensor; 1.2. First temperature sensor; 1.3. Water reservoir tank; 1.4. Second temperature sensor; 1.5. Heating pipe; 1.6. Outlet pipe; 1.7. Temperature-sensitive solenoid valve; 1.8. Water pump; 1.9. Return pipe; 2. Blanket pad; 3. Warm water region; 3.1. First polygon pattern; 3.2. Second polygon pattern; 3.3. Partition; 3.4. Third polygon pattern; 4. Connection pipe; b. Water passage.

DETAILED DESCRIPTION

To further illustrate, embodiments detailing a hydronic heating pad are described below. It should be noted that the following embodiments are intended to describe and not to limit the disclosure.

Referring to FIGS. 1-4, provided is a hydronic heating pad comprising a control unit 1 and a blanket pad 2 connected to the control unit 1; the blanket pad comprises a warm water region 3.

The control unit 1 comprises a water reservoir tank 1.3; a heating pipe 1.5 configured to heat the water and an outlet pipe 1.6 configured to supply hot water to the blanket pad are disposed on the water reservoir tank 1.3; the outlet pipe 1.6 extends into the warm water region 3; the outlet pipe 1.6 is provided with a water pump 1.8 configured to pump the hot water to the warm water region 3.

Furthermore, at least one return pipe 1.9 is disposed on the water reservoir tank 1.3. The at least one return pipe is provided with a temperature-sensitive solenoid valve 1.7, which is configured to control the opening/closing of the return pipe 1.9 based on the temperature of the water in the return pipe. The return pipe 1.9 extends into the warm water region 3; and the outlet pipe 1.6, the at least one return pipe 1.9, and the warm water region 3 form a circulating water channel.

The outlet pipe 1.6 and the at least one return pipe 1.9 communicate with the warm water region 3 via corresponding connection pipes 4.

The water level sensor 1.1 is disposed in the water reservoir tank 1.3 to detect the water level in the water reservoir tank 1.3 and the first temperature sensor 1.2 is disposed in the water reservoir tank to measure the water temperature. The return pipe 1.9 is equipped with the second temperature sensor 1.4 to detect the temperature of the return water. When the water temperature is too low, the temperature-sensitive solenoid valve 1.7 is switched on and the water flows into the water reservoir tank 1.3 and is heated for circulation. On the contrary, when the water temperature is appropriate, there is no need to switch on the temperature-sensitive solenoid valve 1.7, and the whole water flow channel is closed thus saving the energy. The water reservoir tank 1.3 is provided with the first temperature sensor 1.2, so that the outlet water temperature can be measured any time.

The blanket pad 2 further comprises a controller electrically connected to the temperature-sensitive solenoid valve 1.7, the water pump 1.8, and the heating pipe 1.5. The controller comprises an operation panel. Through the controller, the user can control the heating pipe 1.5 to adjust the water temperature, and the flow rate is controlled via the water pump 1.8, so that the water flows to the water heating area 3 at a certain speed and temperature to keep the user warm. The low temperature threshold is controlled through the temperature-sensitive solenoid valve 1.7, so that the water circulation is formed after the water temperature is lower than the threshold, thus saving energy and keeping the water temperature constant.

The blanket pad 2 comprises at least two layers of waterproof fabrics, which can be materials with waterproof effect or ordinary fabrics with waterproof coating. The warm water region 3 is a hermetic region formed on the blanket pad 2 through a high-frequency heat sealing machine and comprises a plurality of first polygon patterns 3.1 distributed in a matrix form; a plurality of water passages b is formed between the plurality of first polygon patterns 3.1. Furthermore, to facilitate the flow of water in a certain direction in the water heating area 3, a plurality of partitions 3.3 is disposed in part of the plurality of water passages to divide the irregular water passages b into a plurality of sub-passages. The outlet pipe 1.6 communicates with the main stream of the circulating water channel, and the at least one return pipe 1.9 communicates with the branch of the circulating water channel; the at least one return pipe 1.9 and the branch of the circulating water channel are equal in number.

With the arrangement of the plurality of sub-passages, different temperature zones are formed. Specifically, the different temperature zones can be controlled by independent temperature-sensitive solenoid valves 1.7. Through setting the low temperature thresholds of the temperature-sensitive solenoid valves 1.7, the water temperature of the water flow channel in the corresponding temperature zone can be controlled, and then different temperature zones are formed.

To facilitate the water circulation, improve the surface flatness of the warm water region 3, and ensure the water flow speed, the warm water region further comprises a plurality of second polygon patterns 3.2 and a plurality of third polygon patterns 3.4; the plurality of second polygon patterns 3.2 is disposed between the plurality of first polygon patterns 3.1, and the outer walls of the plurality of second polygon patterns are parallel to corresponding outer walls of the plurality of first polygon patterns 3.1, respectively; the plurality of third polygon patterns 3.4 is disposed between the plurality of first polygon patterns 3.1 and the walls of the hermetic region, and the outer walls of the plurality of third polygon patterns 3.4 are parallel to the walls of the hermetic region and corresponding outer walls of the plurality of first polygon patterns. In this way, the width of the water flow channel is controlled within a certain range, facilitating the water circulation and the surface flatness of the warm water region 3, which is conducive to reducing the water flow resistance and increasing the water flow rate thus achieving rapid heating of the blanket.

The use of the blanket of the disclosure can save the water consumption. The volume of the water reservoir tank 1.3 of the disclosure is 600 mL, and the water volume of the blanket pad 2 is about 1400 mL, while the water volume of a traditional quadrilateral blanket pad 2 is about 1800 mL, saving 22% of water.

In this disclosure, the heating pipe operates under fuzzy power control, which can improve the effect of intelligent temperature control and make sure the temperature constant.

In this disclosure, the plurality of first polygon patterns is hexagonal patterns. The sum of the perimeter of the hexagon is the smallest compared with other shapes when covering a certain area. Meanwhile, the hexagonal patterns are combined with the diamond patterns to ensure the thermal effect of the blanket pad.

The implementation of the hydronic heating pad of the disclosure is detailed as follows.

When in use, the user can control the heating pipe 1.5 to adjust the water temperature through the controller, and control the flow rate through the water pump 1.8 so that the hot water enters the warm water region 3 at a certain flow rate and temperature to keep the user warm. Thereafter, the low temperature threshold is controlled through the temperature-sensitive solenoid valve 1.7 so that the water circulation is formed after the water temperature is lower than the threshold, thus saving energy and keeping the water temperature constant.

Figure 4:
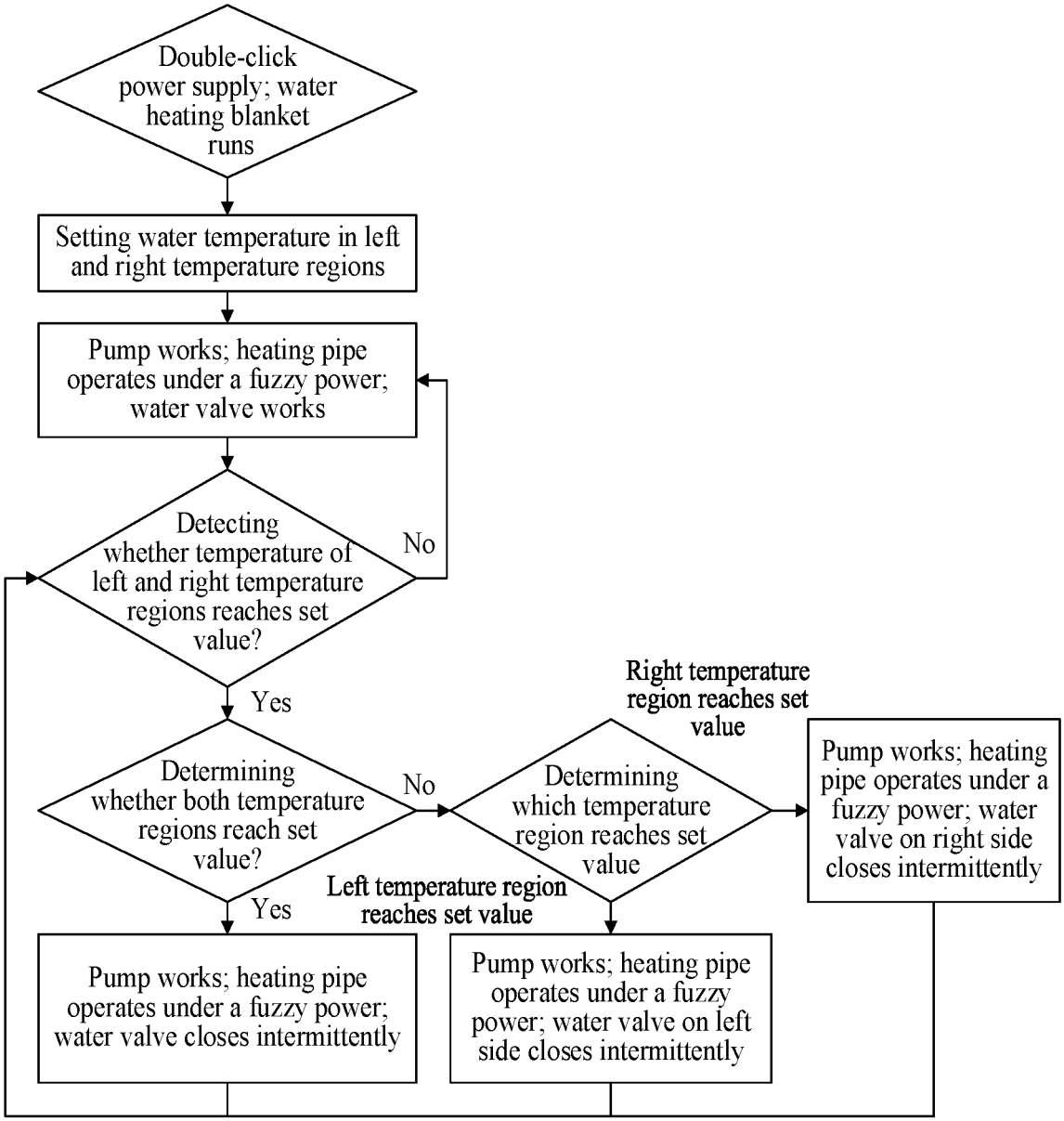
FIG. 4 is a work flow chart of a hydronic heating pad according to one embodiment of the disclosure.

As shown in FIG. 4, taking a water flow channel comprising two sub-passages as an example, after the blanket operating for a period of time, the actual temperature of the second temperature sensor 1.4 on each return pipe 1.9 is compared with the temperature set by the user through the controller, and then the opening and closing of the return pipe 1.9 is controlled through the temperature-sensitive solenoid valve 1.7.

1) When the two sub-passages of the water flow channel reach the set temperature, the water pump 1.8 works continuously, and the heating pipe 1.5 operates at a reduced power; the temperature-sensitive solenoid valves 1.7 of the two return pipes 1.9 are closed intermittently to maintain the temperature of the two return pipes 1.9.

2) When the left sub-passage of the water flow channel reaches the set temperature, the water pump 1.8 works continuously, and the heating pipe 1.5 operates at a reduced power; the temperature-sensitive solenoid valve 1.7 of the left return pipe 1.9 is closed intermittently to maintain the temperature of the left return pipe 1.9.

3) When the right sub-passage of the water flow channel reaches the set temperature, the water pump 1.8 works continuously, and the heating pipe 1.5 operates at a fuzzy power; the temperature-sensitive solenoid valve 1.7 of the right return pipe 1.9 is closed intermittently to maintain the temperature of the right return pipe 1.9.

4) when the left and right sub-passages of the water flow channel fail to reach the set temperature, the heating pipe 1.5, the temperature-sensitive solenoid valve 1.7, and the water pump 1.8 work as usual.

In this way, the efficient regulation of the warm water region 3 is realized, and the entire warm water region 3 can be divided into different temperature zones by the plurality of sub-passages thus meeting the needs of different users. Moreover, the surface of the warm water regions 3 is flat, improving the comfort level of the blanket.

It will be obvious to those skilled in the art that changes and modifications may be made, and therefore, the aim in the appended claims is to cover all such changes and modifications.

The invention claimed is:

1. A hydronic heating pad, comprising:

a control unit, the control unit comprising a water reservoir tank, a heating pipe, an outlet pipe, and at least one return pipe; and a blanket pad connected to the control unit, and the blanket pad comprising a warm water region; wherein:

the heating pipe, the outlet pipe, and the at least one return pipe are disposed on the water reservoir tank;

the outlet pipe and the at least one return pipe extend into the warm water region, whereby the outlet pipe, the at least one return pipe, and the warm water region form a circulating water channel;

the outlet pipe is provided with a water pump; the at least one return pipe is provided with a solenoid valve with controlled opening/closing based on preset values of water temperature in the return pipe; and the blanket pad comprises at least two layers of waterproof fabrics; the warm water region is a hermetic region on the blanket pad and comprises a plurality of first polygon patterns; a plurality of water passages is formed between the plurality of first polygon patterns; a plurality of partitions is disposed in part of the plurality of water passages to divide the water passages into a plurality of sub-passages.

2. The hydronic heating pad of claim 1, wherein the blanket pad further comprises a controller electrically connected to the solenoid valve, the water pump, and the heating pipe, and the controller comprises an operation panel.

3. The hydronic heating pad of claim 2, wherein the hermetic region of the warm water region is formed on the blanket pad through a high-frequency heat sealing machine.

4. The hydronic heating pad of claim 1, wherein the plurality of first polygon patterns is disposed in a matrix form.

5. The hydronic heating pad of claim 2, wherein the plurality of first polygon patterns is disposed in a matrix form.

6. The hydronic heating pad of claim 3, wherein the plurality of first polygon patterns is disposed in a matrix form.

7. The hydronic heating pad of claim 1, wherein a water level sensor and a first temperature sensor are disposed in the water reservoir tank, and a second temperature sensor is disposed on the at least one return pipe.

8. The hydronic heating pad of claim 1, wherein the outlet pipe communicates with a main stream of the circulating water channel, and the at least one return pipe communicates with a branch of the circulating water channel; the at least one return pipe and the branch of the circulating water channel are equal in number.

9. The hydronic heating pad of claim 1, wherein the heating pipe operates under power controller based on fuzzy logic.

10. The hydronic heating pad of claim 1, wherein the plurality of first polygon patterns is hexagonal patterns.

11. The hydronic heating pad of claim 10, wherein the warm water region further comprises a plurality of second polygon patterns and a plurality of third polygon patterns; the plurality of second polygon patterns is disposed between the plurality of first polygon patterns, and outer walls of the plurality of second polygon patterns are parallel to corresponding outer walls of the plurality of first polygon patterns, respectively; the plurality of third polygon patterns is disposed between the plurality of first polygon patterns and walls of the hermetic region, and outer walls of the plurality of third polygon patterns are parallel to the walls of the hermetic region and corresponding outer walls of the plurality of first polygon patterns.

12. The hydronic heating pad of claim 1, wherein the outlet pipe and the at least one return pipe communicate with the warm water region via corresponding connection pipes.

* * * * *